United States Patent [19]

Mengel

[11] 4,204,650

[45] May 27, 1980

[54] APPARATUS FOR REPLACING ROTATING MANDRELS ON WHICH A WEB IS WOUND

[75] Inventor: William R. Mengel, Easthampton, Mass.

[73] Assignee: Magnat Corp., Easthampton, Mass.

[21] Appl. No.: 871,592

[22] Filed: Jan. 23, 1978

[51] Int. Cl.[2] ..... B65H 19/26; B65H 19/28; B65H 19/30

[52] U.S. Cl. ..... 242/56 R

[58] Field of Search ..... 242/56 R, 56 A, 56.2–56.8, 242/65, 66, 58.6, 75.1, 58–58.5; 156/502, 504

[56] References Cited

U.S. PATENT DOCUMENTS

| | | | |
|---|---|---|---|
| 1,881,871 | 10/1932 | Malkin | 43/85 |
| 1,949,238 | 2/1934 | Broadmeyer | 242/58.6 |
| 2,232,371 | 2/1941 | Corbin et al. | 179/18 HA |
| 2,272,940 | 2/1942 | Gerard | 242/56.6 |
| 2,361,264 | 10/1944 | Christman | 242/56.6 |
| 2,364,888 | 12/1944 | Avcock | 242/56.6 |
| 2,507,144 | 5/1950 | Christman | 242/56.6 |
| 2,553,052 | 5/1951 | Kwitek | 82/84 |
| 2,783,000 | 2/1957 | Huecking et al. | 242/56.6 |
| 2,943,806 | 7/1960 | Phelps | 242/56 A |
| 3,030,045 | 4/1962 | Rehklaw | 242/74 |
| 3,094,294 | 6/1963 | Kiesel | 242/65 |
| 3,176,928 | 4/1965 | Saunders | 242/58.6 |
| 3,191,883 | 6/1965 | Wells | 242/56 R |
| 3,321,149 | 5/1967 | Anderson et al. | 242/74 |
| 3,486,707 | 12/1969 | McCreary | 242/56 R |
| 3,633,839 | 1/1972 | Clark | 242/56 R |
| 3,704,835 | 12/1972 | Harley | 242/56 A |
| 3,791,602 | 2/1974 | Isakson | 242/56 A |
| 3,791,603 | 2/1974 | Lenius | 242/56 R |
| 3,889,892 | 6/1975 | Melead | 242/56 R |
| 4,069,986 | 1/1978 | Carlsen | 241/56 A |

*Primary Examiner*—John M. Jillions
*Attorney, Agent, or Firm*—Edgar H. Kent

[57] ABSTRACT

Apparatus for replacing rotating mandrels on which a web is wound, featuring, in various aspects, a surface drive for accelerating new mandrels up to web speed prior to splicing combined with a center drive for rotating the mandrels, the center drive being continually engaged with the mandrels along a transfer path between splicing and main rotation stations, improved means to transfer mandrels between stations, improved splicing and web severing means, and means to load successive mandrels into the apparatus.

41 Claims, 10 Drawing Figures

APPARATUS FOR REPLACING ROTATING MANDRELS ON WHICH A WEB IS WOUND

BACKGROUND OF THE INVENTION

This invention relates to apparatus for replacing rotating mandrels on which paper, fabric or other web is wound in a process of applying the web to, or removing it from, a succession of the mandrels. The invention is illustrated and described as applied to a winder, in which the web is wound onto the mandrels to be replaced.

Typically such winding may be for the purpose of continuously rewinding a succession of mill rolls of the web into smaller rolls for use by the consumer, or to rewind a web after it has passed through web processing machinery.

When successive rolls are to be wound it is desirable to be able, automatically and without interrupting the winding, to sever the web from a fully wound roll and adhere the severed end to a new mandrel. To avoid a shock on the web when it adheres to the new mandrel, the mandrel should already be rotating at a surface speed equal to the web speed. It is also desirable in such winding apparatus to transfer mandrels between stations, e.g., in a winder, between loading, splicing, winding and unloading stations.

Two types of mandrel drive systems are in common use: center drives which rotate the mandrel at a controlled angular speed; and surface drives, which directly engage the surface of the core-supporting mandrel, or even the web itself as it winds onto the mandrel, providing direct control over surface speed. To maintain constant surface speed, center drives automatically slow angular speed as the diameter of the roll being wound grows in diameter. Conventional center drive winders employ costly and complex turret arrangements to accomplish automatic splicing of new mandrels.

SUMMARY OF THE INVENTION

The invention provides a compact and relatively inexpensive winder capable of winding rolls of varying diameters. The cost and complexity of turret arrangements are avoided. Roll transfer and splicing are carried out without substantial web shock, and with minimum change in the path of the web being wound. In preferred embodiments the web surface is free of contact with drive belts or the like.

In one aspect the invention features a frame for supporting a first mandrel at a main rotation station with the web wound around the mandrel and extending therefrom, and for supporting a second mandrel at a position spaced from the rotation station (e.g., at a splicing station), a center drive for rotating the first mandrel at the rotation station, a surface drive for accelerating the second mandrel until its peripheral speed matches the surface speed of the web extending from the first mandrel, and splicing means for severing the web and splicing it to the accelerated second mandrel. In preferred embodiments of a winder, the rotation station is a winding station at which the web is wound into a roll on the first mandrel; means are provided to permit the second mandrel to simultaneously engage the center and surface drives while the second mandrel is rotating at an angular speed greater than that of the first mandrel (e.g., an overrunning clutch); the mandrels have portions for frictionally engaging (e.g., by belts) the surface drive; and the mandrels each include means for engaging the center drive over an extended region between the rotation station and the position spaced therefrom (e.g., sprocket wheels engaging a chain).

In another aspect the invention features providing transfer means for translating the second mandrel along a path between stations after splicing and while in driving engagement with a drive means. In preferred embodiments the path is linear; and the mandrel has rollers for engaging bearing surfaces extending along the path.

In still another aspect the invention features splicing the web to the second mandrel by providing a stationary cutting edge on one side of the web and downstream of the second mandrel at a splicing station, an anvil on the opposite side of the web having a deflecting surface downstream of the cutting edge, means for moving the anvil toward the web to deflect the moving web toward the cutting edge, a splice roll on the opposite side of the web, the splice roll including a freely rotatable peripheral portion for supporting the moving web, and means to move the splice roll toward the web to nip the web against the second mandrel as the anvil deflects the web into contact with the cutting edge. In preferred embodiments the splice roll is rotatably supported about an eccentric axis spaced from its center, whereby rotation of the splice roll about the eccentric axis nips the web against the second mandrel; the anvil and surface drive belt pulleys rotate about the same eccentric axis; center drive chains extend between sprocket wheels located at the rotation and splicing stations; the anvil includes a blade extending to contact the web upstream of the cutting edge and downstream of the splice roll, such that the deflecting surface and the blade form a well across which the web is tightly stretched and into which the cutting edge extends upon movement of the anvil; blowing air is directed toward the second mandrel from the vicinity of the anvil, for blowing the severed end against a core on the mandrel; adhesive means is applied to the core, for adhering the severed end of the web to the core; and the rotatable peripheral portion of the splice roll is continually in supporting contact with the moving web.

In still another aspect the invention features a loading apparatus including guide means with bearing surfaces for supporting rolling end portions of new mandrels sloping upward from the first station in the winder apparatus, first retention means along the guide means (e.g., pins extending above the bearing surfaces), for retaining a first one of the new mandrels, retraction means to retract the first retention means to allow the first new mandrel to roll down the sloping bearing surfaces into the first station. In preferred embodiments additional retention and retraction means are provided to advance a second new mandrel toward the position vacated by the first mandrel; rocker arms connect the pins of the retention means; means are provided to rotate the rocker arms through successive half-cycle rotations, each said half-cycle rotation thereby advancing the mandrels to the next downstream retention means and two half-cycle rotations being required to advance the second new mandrel to the original site of the first mandrel; and entrances to channels in the guide members connecting the rotation and splicing stations are provided at the base of the sloping guide means.

In still another aspect the invention features transferring between stations mandrels supported on rolling end portions using pusher shoes adapted to push against said rolling end portions. In preferred embodiments opposing guide members have inwardly-facing channels to receive the end portions of the mandrels and guide the pusher shoes, a common shaft is rotatably connected to each pusher shoe, rack gears are fixed to the guide members and uniformly spaced from the channels along the length of the channels, pinion gears are fixed to the common shaft and engage with the racks for rotating along the racks as the shoes are moved, thereby maintaining alignment between the shoes.

In still another aspect the invention features a removable mandrel for use in such apparatus, including a main body for supporting a core on which web material is wound, means for engaging a center drive (e.g., sprocket wheels and chain), and portions adapted for rolling on horizontal and inclined bearing surfaces.

PREFERRED EMBODIMENT

The structure and operation of the preferred embodiment of the invention is as follows:

Structure

The drawings show the preferred embodiment, which is then described.

DRAWINGS

DESCRIPTION

Figure 1:
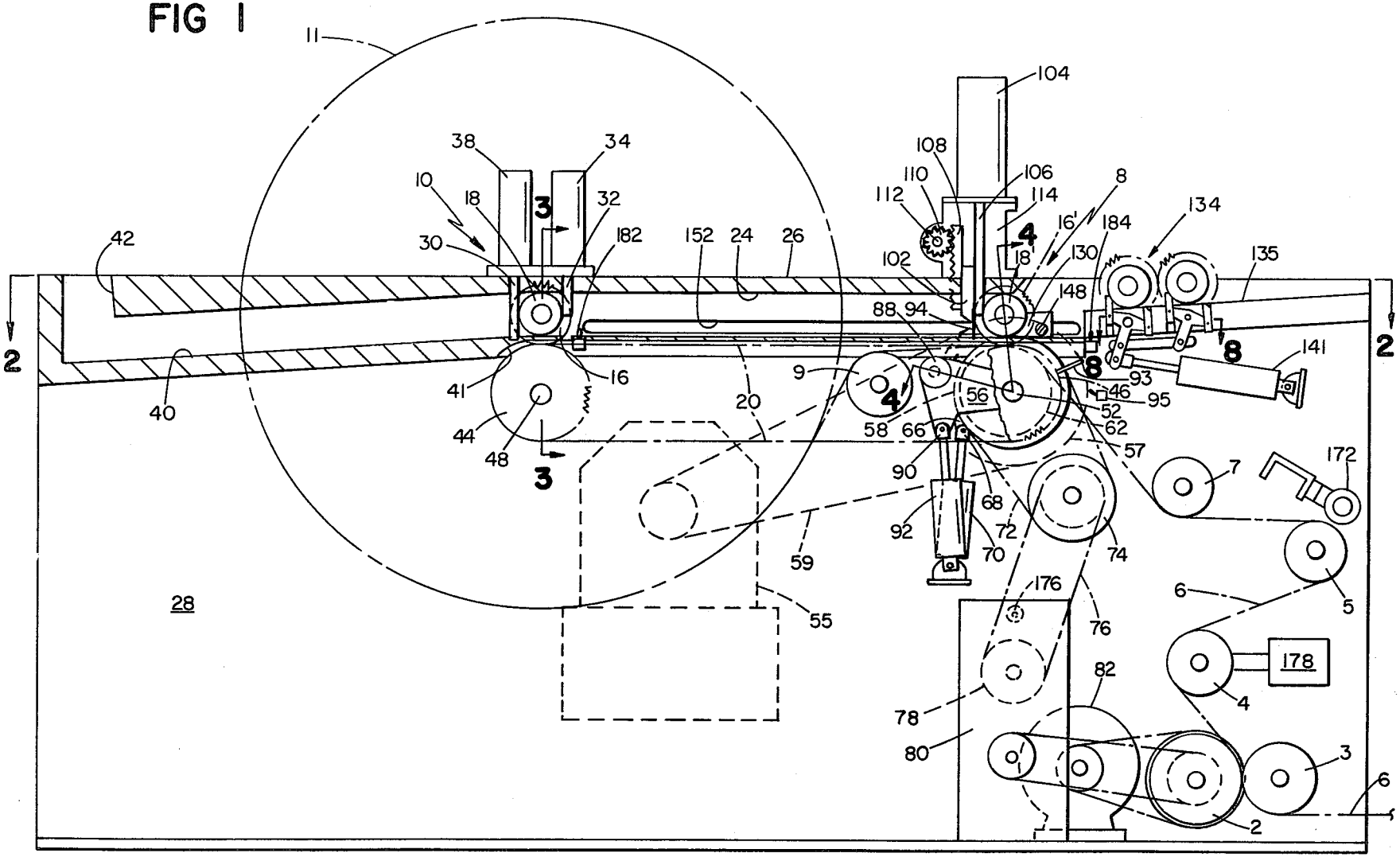
FIG. 1 is a sectional view through 1—1 of FIG. 2 of said embodiment.

Referring to FIG. 1, there is shown a cross-section of an automatic continuous web winding machine. Web material 6 enters from the lower right, fed into the machine through draw roll 2 and rubber nip roll 3. It passes over tension measuring roll 4, hardened slitter roll 5, and spreader roll 7 before passing through splicing station 8. From the splicing station it passes over idler roll 9, and is wound at winding station 10 into roll 11.

Figure 3:
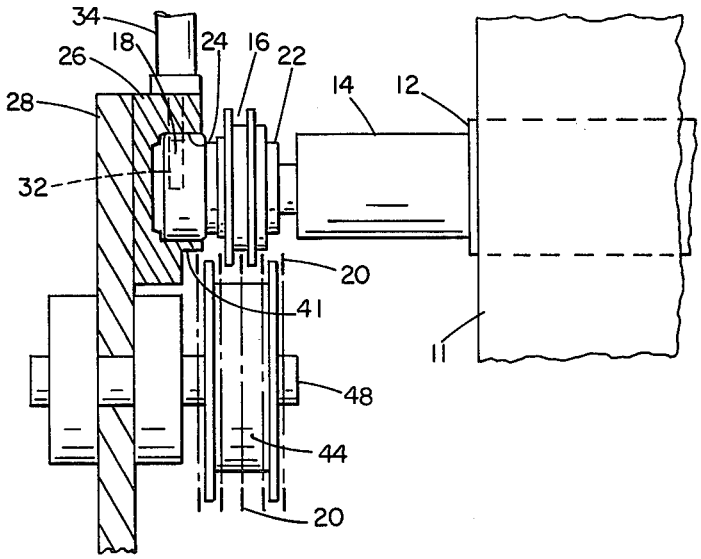
FIG. 3 is a fragmentary sectional view through 3—3 of FIG. 1, showing the winding station.

Turning first to the winding station, shown in cross-section in FIG. 3, roll 11 and core 12 are supported by mandrel 14. Buttons (not shown) in the mandrel periphery are pressed outward by a pressurized tube within the mandrel to grip the interior of core 12. On both ends of mandrel 14 are fastened sprocket wheels 16 and ball bearing rollers 18 (one number designation is used throughout for identical left and right elements of the machine). Each sprocket wheel has two rings of teeth to mesh with the inside strands of four strand roller chains 20, which extend horizontally beneath each sprocket wheel.

The sprocket wheels are attached to the mandrel by overrunning clutches 22 (cam clutch #B-207, Morse Division of Borg-Warner, 730 Great Southwest Parkway, Atlanta, Ga. 30336) supported on bushings (not shown). Rollers 18 ride in inwardly-opening channels 24 of guide members 26, attached to each frame wall 28. At winding station 10, rollers 18 are held between roll release pins 30 and latch pins 32 (FIG. 1). Roll release cylinders 38 and latch cylinders 34, fastened to the top surface of guide members 26, actuate release pins 30 and latch pins 32, respectively.

Figure 2:
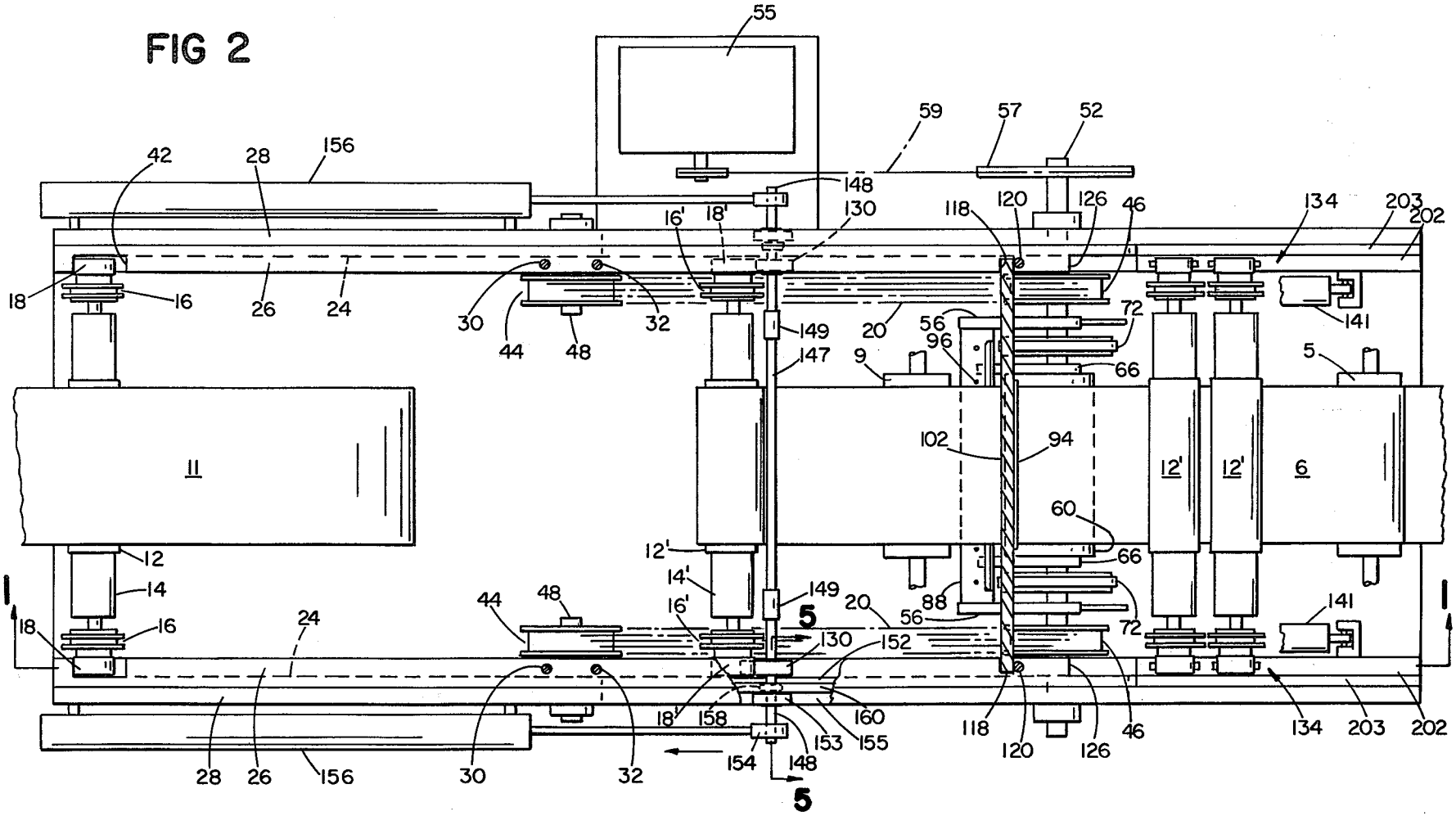
FIG. 2 is a sectional view through 2—2 of FIG. 1 of said embodiment.
Figure 4:
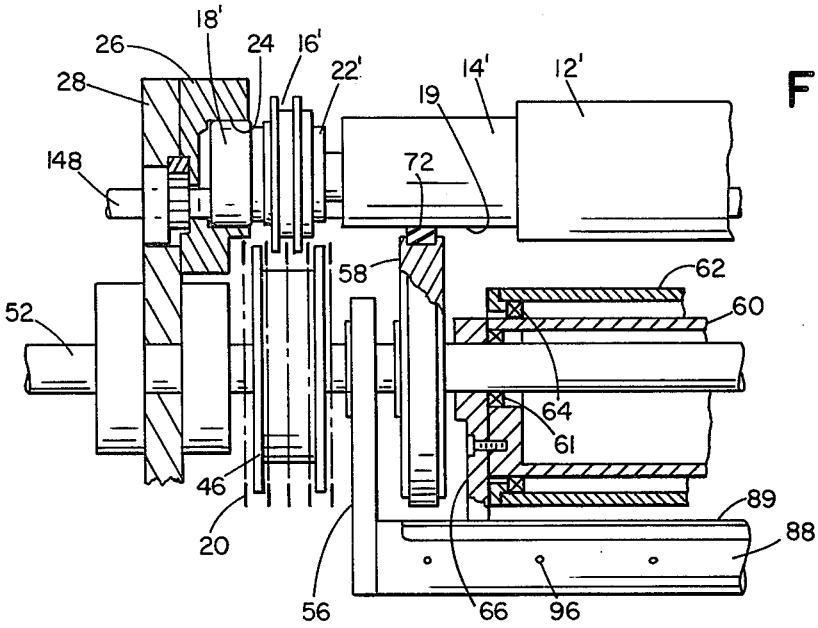
FIG. 4 is a fragmentary sectional view through 4—4 of FIG. 1, showing the splicing station.

Channels 24 extend between roll exit 42 and splicing station 8. Toward roll exit 42, the channels slope downwardly at a 4° slope in region 40. Between winding station 10 and splicing station 8 the channels are horizontal. Parallel to and below channels 24, roller chains 20 extend horizontally between the winding and splicing station. Guide members 26 are relieved at 41 to clear chains 20. Sprocket wheels 44, keyed to stub shafts 48 (FIGS. 1, 2, and 3), engage the chains at the winding station. Sprocket wheels 46, keyed to common shaft 52 (FIGS. 1 and 4), engage the chain at the splicing station. Stub shafts 48 and shaft 52 are supported on frame-mounted bearings. Chain drive 55 (a tension-regulated variable-speed center drive, including a 10 horsepower DC motor #T18R1313 and control electronics, supplied by Reliance Electric Company, 24701 Euclid Avenue, Cleveland, Ohio 44117) drives shaft 52 by means of drive chain 59 and single outside sprocket wheel 57 attached to the shaft (FIGS. 1 and 2).

Turning now to the splicing station (shown in cross-section in FIG. 4), shaft 52 which drives chain sprocket wheels 46 also serves as an idler shaft for anvil arms 56, surface drive belt pulleys 58, and splice roll 60, all mounted on idler bearings below new mandrel 14'. Splice roll 60 is eccentrically mounted to shaft 52 by bearings 61. A rolling surface for the traveling web is provided by revolving outer shell 62, which revolves about the periphery of the splice roll on ball bearings 64. Arm 66 fastened to one end of splice roll 60 is bolted to clevis 68 (FIG. 1) of pneumatic cylinder 70; actuation of the cylinder moves splice roll 60 and its shell 62 in an eccentric path during splicing, into and out of nip with new core 12'.

Outside the splice roll and also idler mounted are two surface drive pulleys 58 (one shown in FIG. 4), driven by fabric reinforced rubber drive belts 72, which engage surface 19 of new mandrel 14'. Belts 72 emanate from intermediate, frame mounted pulleys 74 (FIG. 1), which are in turn driven by belt 76 from output pulley 78 of positively infinitely variable speed (PIV) transmission 80. Through further drive belts, motor 82 (2 horsepower DC, Reliance Electric #T16G3030) drives both transmission 80 and draw roll 2, which presses against rubber nip roll 3 to feed web 6 into the machine.

Figure 7:
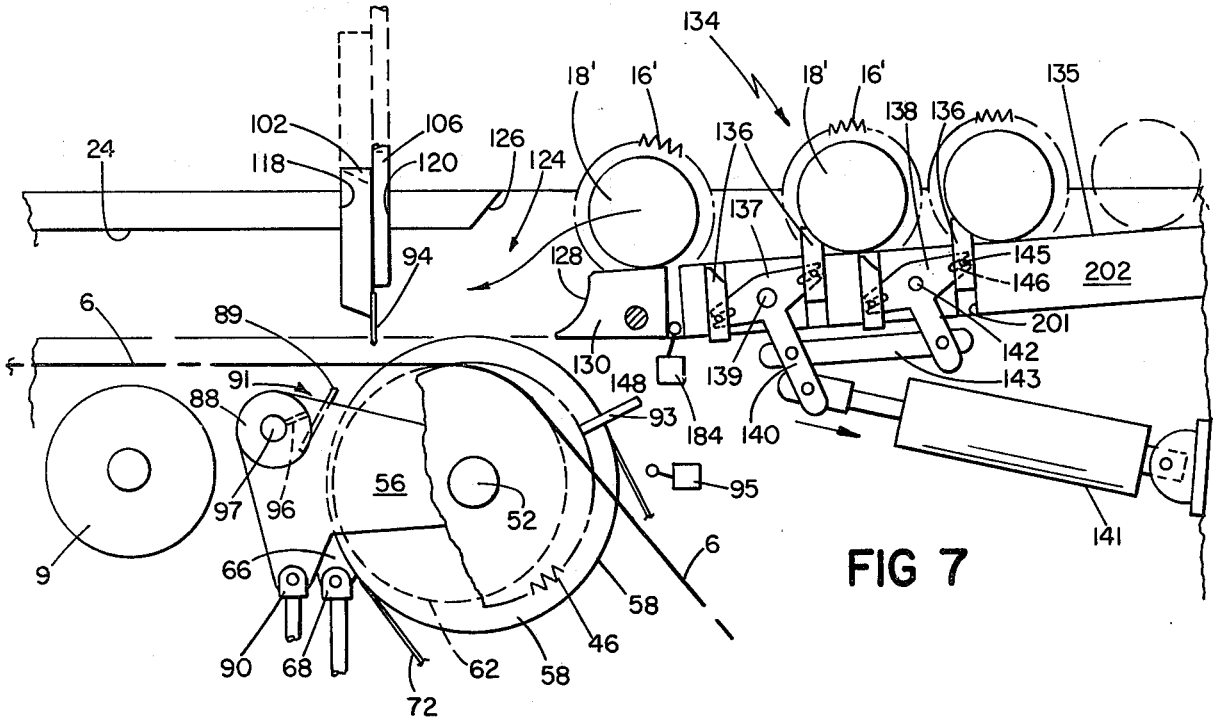
FIG. 7 is a fragmentary, enlarged view of FIG. 1, showing the mandrel loading operation and knife motion.
Figure 6:
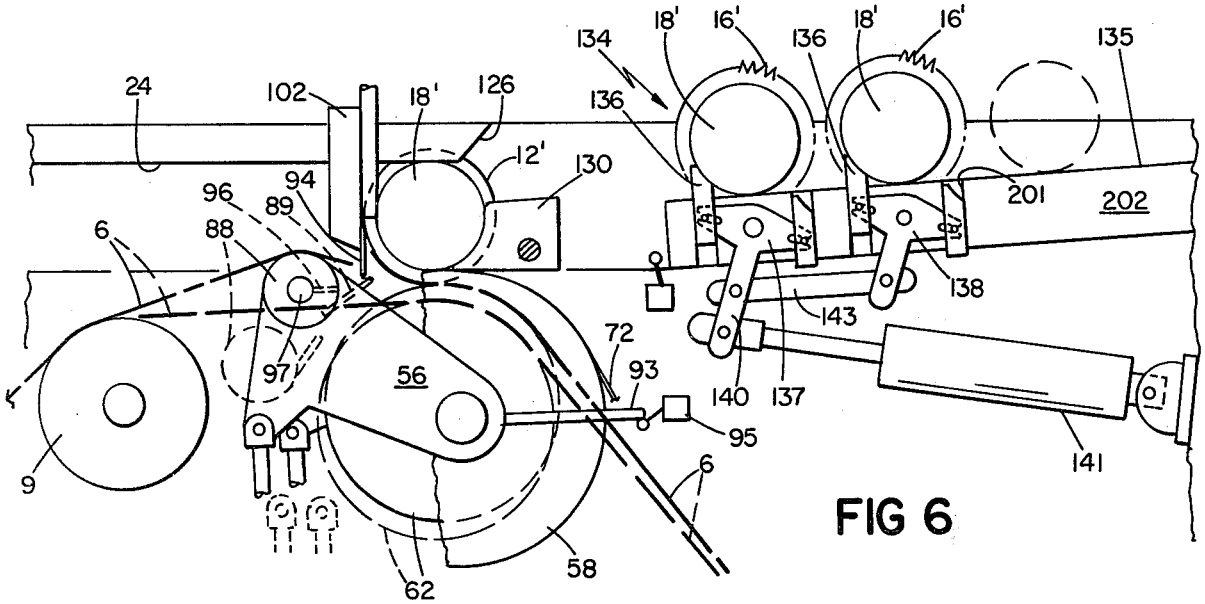
FIG. 6 is a fragmentary, somewhat diagrammatic, enlarged view of FIG. 1, showing the web cutting operation (sprocket wheels have been removed for clarity).

On the outside of each surface drive pulley 58 are idler mounted anvil arms 56 (FIGS. 4 and 1), supporting each end of anvil bar 88. The folded sectional view of FIG. 4 makes bar 88 appear below splice roll 60 when it actually is to one side of it, as shown in FIG. 1. Anvil bar 88 horizontally extends normally just below traveling web 6. Blade 89 is fastened to one side of anvil bar 88, forming well 91 (FIGS. 6 and 7). One of arms 56 is bolted to clevis 90 of pneumatic cylinder 92 (FIG. 1). During a splicing operation actuation of cylinder 92 raises anvil bar 88 and its blade 89 into position to cooperate with knife 94 in cutting the web (FIG. 6). Anvil limit switch 95 and stop finger 93 (FIGS. 1 and 6) on the anvil arm control the maximum travel of anvil bar 88. Air jet holes 96 (several spaced widthwise) communicating with interior air passage 97 of anvil bar 88 (FIGS. 6 and 7) provide a blowing air stream into well 91 to blow the cut end of web 6 against axially-oriented sticky tape (not shown) on new core 12'.

Turning to FIGS. 1 and 7, knife 94 has a serrated cutting edge and is fastened to knife bar 102. The bar is raised (the raised position being shown in dashed lines in FIG. 7) from its normally down position, in which it clears the traveling web, by means of pneumatic cylinders 104 and cylinder rods 106 fastened to one side of the bar. To maintain alignment, rack gears 108 are fastened to bar 102, and cooperate with pinion gears 110, which are key mounted on common shaft 112. Bracket 114 above guide members 26 supports cylinders 104 and the bearings for shaft 112. Slot 118 and hole 120 (FIGS. 2 and 7) in the top surface of guide members 26 accept cylinder rods 106 and the ends of knife bar 102. In the knife bar's normal down position, cylinder rods 106 horizontally retain new mandrel 14'. The lower portions of cylinder rods 106 extend into holes 120 and rest against one side of rollers 18' of new mandrel 14' inside channels 24 (FIG. 1).

Figure 8:
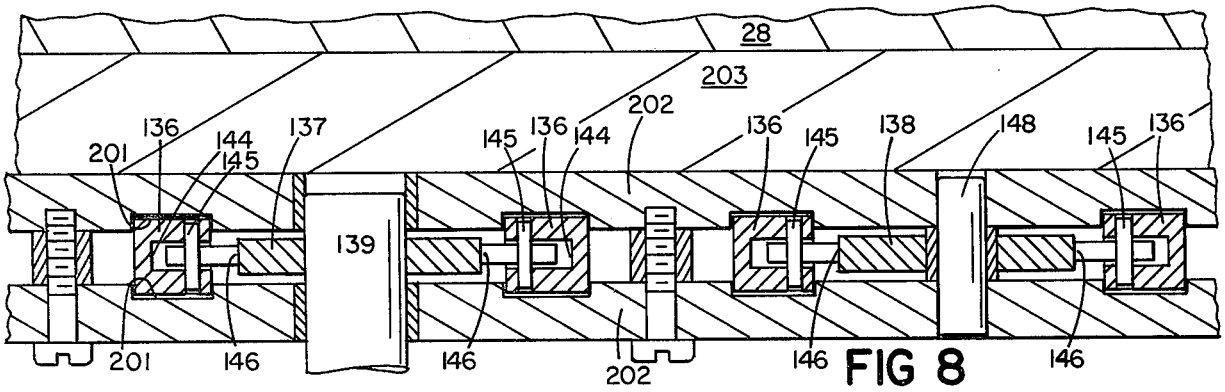
FIG. 8 is a fragmentary sectional view taken through 8—8 of FIG. 1, showing the rocker arm linkage of the mandrel loader.

New mandrels are stored in loader 134 (FIGS. 1 and 7) which has guideways 135 for the new mandrel rollers 18' sloping downwardly at about a 4° angle toward splicing station 8. The new mandrels enter channels 24 from loader 134 through channel entrances 124, formed by sloping surfaces 126 on channel 24 and working surfaces 128 of retracted shoes 130. Rubber bumpers could be added to surfaces 126 to cushion the mandrels during ingress. The new mandrels are held in loader 134 by staggered, tapered pins 136 (four on each side of the machine) acting against rollers 18' of the mandrels. First and second pairs of rocker arms 137, 138 alternately raise tapered pins 136. First rocker arms 137 (one shown) are keyed to rotating shaft 138, and driven by extension 140 on one arm connected to the piston rod of pneumatic cylinder 141. Second rocker arms 138 (one rotating on fixed shaft 142 shown) are driven by connecting links 143. The rocker arms fit within recessed portions 144 in each tapered pin (FIG. 8); dowels 145 in the tapered pins cooperate with slots 146 (FIG. 7) in the rocker arms. As seen in cross-section in FIG. 8, pins 136 are contained in facing slots 201 between two spaced plates 202 mounted on adaptor plate 203 inside frame walls 28.

Figure 5:
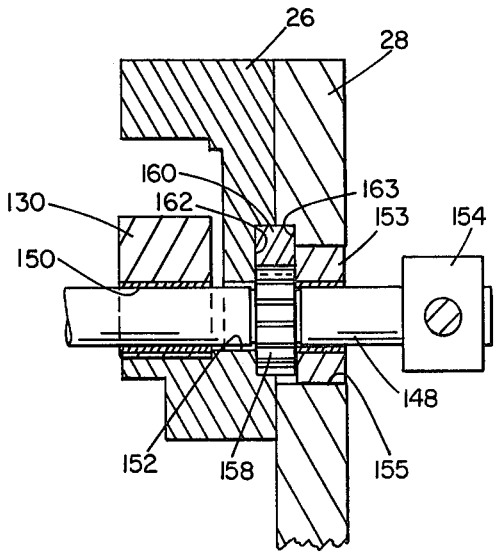
FIG. 5 is a fragmentary sectional view through 5—5 of FIG. 2, showing one guide member and shoe.

The linear transfer between splicing and winding stations is accomplished by shoes 130 (FIGS. 2, 6 and 7) traveling within channels 24 pushing rollers 18' on each end of new mandrel 14'. A new mandrel is shown in mid-transfer in FIG. 2. Connecting the two shoes in central shaft 147, which is joined by couplings 149 to outside shafts 148 (FIG. 2), which, in turn, pass through bushed bores 150 (FIG. 5) in each shoe 130, slots 152 at the base of channels 24 in each guide member 26, and bushings in guide block 153 sliding in slot 155 in frame wall 28. Outside the frame wall, shaft 148 is secured to piston rod ends 154 (FIG. 2) of pneumatic cylinders 156. To maintain alignment between the two shoes, pinion gears 158 fastened to shaft 148 engage racks 160 secured between guide members 26 and frame walls 28 in slots 162, 163 (FIG. 5).

Control circuitry (FIG. 9) for the machine consists of a Reliance Electric Company Automate 31 programmed to achieve the operational sequence described below.

Operation

In normal rewinding operation of the machine, draw roll 2 and opposed rubber nip roll 3, under power from motor 82, feed the web material into the machine. The web passes over tension roll 4 and then across hardened slitter roll 5, where conventional pneumatically loaded slitting wheels 172 (FIG. 1) can slit the web longitudinally into a plurality of narrower webs. If the web is split at the splitter, correspondingly sized multiple cores would substitute for single core 12, and the rewound roll would break into multiple rolls on removal from the mandrel. After leaving the slitter roll, the web passes across bowed spreader roll 7, which serves to spread apart individual slit webs, preventing edge interface at latter stages of rewinding. The spreader roll is not needed, but may be retained, with unslit webs. The web passes next across revolving outer roll 62 of splice roll 60, and then across idler roll 9 onto winding roll 11.

Chain drive 55 center drives roll 11 (FIGS. 1 and 2). The drive output is coupled to four strand chains 20 by drive chain 59 through outside sprocket wheel 57 keyed to shaft 52. This drives chains 20 in unison. The chains, in turn, rotate mandrel 14 and roll 11 by turning sprocket wheels 16 (FIG. 3), the mandrel being horizontally retained between release pins 30 and latch pins 32 and rotating on ball bearing rollers 18 inside channels 24.

As with conventional center drive rewinders, as roll 11 grows in diameter its angular speed must be reduced to maintain the constant web speed set by draw roll 2, and web tension must be reduced ("tapered") so as not to overtighten the winding roll. To accomplish this the electrical output of tension load transducer 178 (shown diagrammatically in FIG. 1) is fed back to tension-regulated variable-speed chain drive 55. The drive includes circuitry and a motor. At completion of rewinding, chain drive 55 and chains 20 will be moving at a small fraction of their original speed.

While roll 11 is rewinding, new mandrel 14 is situated at splicing station 8. There its sprocket wheels 16' engage chains 20 (FIG. 4), which are slowing down as roll 11 grows in diameter. The surface speed of new core 12' is, however, maintained at the speed of the web traveling beneath it by surface drive belts 72 acting against mandrel surface 19. Overrunning clutches 22' between mandrel 14' and sprocket wheels 16' allow the mandrel to rotate faster than chain driven sprocket wheels 16'. PIV transmission 80 powers belt 72, and is manually adjusted at knob 176 to produce the desired matching belt speed.

When roll 11 is fully wound, the machine operator initiates the splice cycle by depressing the splice button in the control circuitry (shown schematically in FIG. 9 and described along with the Automate 31 Programmable Controller in a subsequent section); the web is cut and adhered to new core 12' at the splicing station. FIG. 6 illustrates the splicing sequence. Knife 94 and bar 102 are in their normal down position. New mandrel 14' with new core 12' is rotating at web speed and is retained horizontally between knife cylinder rods 106 and shoes 130. Splice roll pneumatic cylinder 70 and anvil bar pneumatic cylinder 92 (shown by dashed lines in their normal down position) begin the splicing sequence by simultaneously actuating, raising splice roll 60 and anvil bar 88 with its attached blade 89.

The web is deflected out of its normal horizontal path and stretched tight across V-shaped well 91 formed between anvil bar 88 and blade 89 (web deflection is exaggerated in FIG. 6). Just prior to web contact with knife 94, rotary shell 62 of splice roll 60 nips the web against sticky tape on the surface of new core 12'. Then, almost simultaneously, the serrated edge of knife 94 cuts the web, and blowing air from holes 96 forces the severed end of the web against the sticky tape on the new core. When anvil limit switch 95 is contacted by stop finger 93, a series of events occur simultaneously: both the anvil bar and splice roll retract; compressed air to holes 96 is shut off; and roll release pins 30 are retracted by actuation of release cylinders 38.

Before the web is cut, simultaneous with actuation of cylinders 70, 92, chain drive 55 is electrically instructed by the control circuitry (FIG. 9) to switch into a speed-match mode, wherein it accelerates to a pre-set speed that will match core surface speed with web speed. The web is severed, however, by rapidly acting anvil bar 88 before an appreciable change in chain drive speed occurs. Until chains 20 reach the pre-set speed, belts 72 maintain surface speed of new core 12' at web speed.

With release pins 30 retracted, completed roll 11 is kicked forward by chains 20 into the 4 degree downwardly-sloping extensions of channels 24, rolling until it reaches roll exit 42, where it is lifted from the machine. Mandrel guide plates (not shown) extending upward from the lower inside surface of guide members 26 provide a lip that prevents rollers 18 from leaving channels 24 in the event roll 11 became skewed during the downhill roll.

After a preset time period sufficient to assure that roll 11 has reached the roll exit and that chains 20 have reached the desired speed, roll release cylinders 38 are operated, restoring release pins 30 to their normal down position; and chain drive 55 is switched back to its tension-regulated variable-speed mode. During the small pre-set time period, web material has wound onto new core 12', there being sufficient clearance between the core and retracted shell 62 of the splice roll and shaft 147 to permit this. Rods 106 and shoes 130 rest against rollers 18' well outside the core, and do not interfere with the web. Both chains 20 and drive belts 72 now drive new mandrel 14' at the proper speed. This ends the splice cycle; and the core release cycle automatically begins.

Cylinders 104 are operated to raise knife bar 102 and rods 106, thereby releasing new mandrel 14'. Shoes 130 move the new mandrel forward toward the rewinding station, the shoes actuated by operation of cylinders 156. Racks 160, pinion gears 158, and shafts 147, 148 cooperate to maintain alignment between the shoes. Guide blocks 153 sliding in slots 155 retain the shoes vertically. On leaving the splicing station, mandrel 14' loses contact with surface drive belts 72, and is driven solely by chains 20 during the transfer and afterwards. FIG. 2 shows new mandrel 14' midway to the rewinding station and completed roll 11 ready to be lifted from the machine.

At the same time as knife bar 102 and rods 106 rise, latch pins 32 are raised by cylinders 34. Once new mandrel 14' is fully inside winding station 10, with rollers 18' resting against release pins 30 shoes 130 close forward travel limit switch 182, which restores latch pins 32 to their normal down position and causes cylinders 156 to retract the shoes toward the splicing station until reaching retract limit switch 184, whereupon cylinders 156 are deactivated. This completes the core release cycle. Next, the core load cycle is automatically begun.

The core load cycle begins with knife bar 102 and rods 106 being lowered by cylinders 104 to their normal fully lowered position. Next, core load cylinder 141 is actuated a half cycle, from extension to retraction as shown. And, as shown in FIG. 7, this rotates rocker arms 137, 138 counterclockwise, reversing the positions of tapered pins 136 from their FIG. 6 position, and allowing the lowermost mandrel rollers 18' to roll unassisted on guideways 135 into channels 24 at channel entrances 124 where they are stopped by engagement with rods 106, shoes 130 being fully retracted so as to form the channel entrance. At the end of a preset time period, begun at actuation of core load cylinder 141, and sufficiently long to assure loading of the new mandrel, shoes 130 are brought forward by cylinders 156 into contact with rollers 18' on the new mandrel and load cylinder 141 is restored to its original position, rotating rocker arms 137, 138 a half-cycle clockwise and advancing the new mandrels to the position shown in FIG. 6. Shoes 130 exert continuous pressure on rollers 18' until knife bar 102 and rods 106 are released, when the shoes again move a new mandrel to the winding station. Once into the splicing station the new mandrel is immediately spun up to web speed by surface drive belts 172. It remains at that speed during completion of winding, until operator commencement of another splice cycle.

Figure 9:
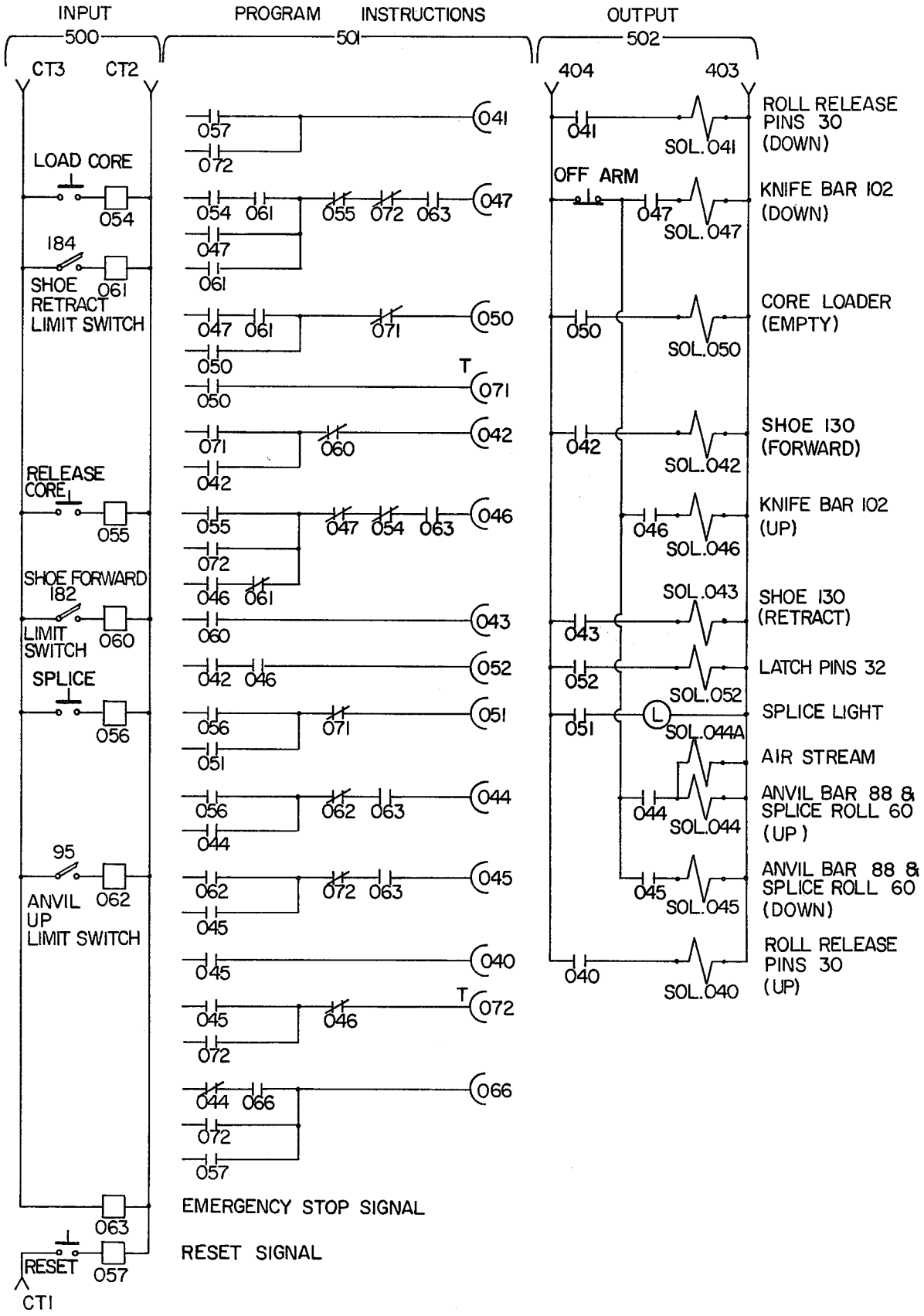
FIG. 9 is a diagrammatic view illustrating operating and sequencing control circuitry for the apparatus.

To load an empty machine, at least two empty mandrels are placed in loader 134, and the reset cycle is begun by pressing the reset button in the control circuitry (FIG. 9). This simply lowers roll release pins 30. Then the core load cycle described above is begun by depressing the load core pushbutton (FIG. 9). After the first mandrel is loaded into the splicing station, the core release cycle described above is begun by depressing the release core button (FIG. 9). This transfers the first mandrel loaded to the rewinding station and automatically repeats the core load cycle, loading the second mandrel. Web material is then threaded through the machine onto roll 11, and rewinding begun.

The electrical operating and sequencing control circuitry for the machine may be readily provided, utilizing either entirely conventional electrical circuit components, such as wires, switches, relays, and solenoids, or a programmable computer controller which replaces many of such components with functionally-equivalent input and output terminals and program instructions. In the preferred embodiment, applicant utilizes such a controller, the Automate (Registered Trademark) 31 Programmable Controller of Reliance Electric Co. aforesaid.

FIG. 9 diagrammatically illustrates operation of the programmable controller of the preferred embodiment. Computer input components, program instructions, and output components for the controller are grouped into three columns 500, 501, 502, respectively, in FIG. 9.

In input section 500 at the left, the lines CT1, CT2 and CT3 represent 110–115 volt AC power lines. The circuits between the power lines provide inputs to the controller. The actual operating controls on the machine and operating console are indicated at the left by legends and numbers from the machine drawings (FIGS. 1-7). Computer input terminals are indicated at the right by numbered boxes, the numbers corresponding with physical terminals on input/output cards of the Automate 31. Each computer input terminal and its function correspond to the coil of a solenoid-operated switch that opens or closes all switch contacts of the same number indicated in the program instructions 501.

Program instructions 501 for the Automate 31 are written in the form of logic circuits each composed of numbered electrically-connected switch contacts, shown either normally open or normally closed by conventional symbols. Each logic circuit terminates in an "internal" output, represented by a semi-circle containing a number. An internal output is energized when a "circuit" is completed from left to right by closed switch contacts. Each internal output is electrically equivalent to the coil of a solenoid-operated switch that opens or closes all switch contacts of the same number either in the program instructions or in output section 502.

In output section 502 at the right, the two vertical lines 403, 404 represent 110–115 volt AC power lines. The circuits between the power lines connect the output terminals of the controller, indicated by numbered switch contacts, with the various machine components and controls, indicated by legends and numbers from the machine drawings. Each output terminal corresponds with a physical terminal on an input/output card of the Automate 31, and is electrically equivalent to switch contacts closed when the same number internal output is energized.

All switches with the same number are operated (i.e., normally-open switches are closed and normally-closed switches are opened) by the control (input terminal or internal output) of the same number.

To initiate a splice cycle, the "SPLICE" pushbutton switch (FIG. 9, left) is depressed to energize input terminal 056 which functions as if it:

closes switch 056 in the logic circuit immediately to its right, thereby energizing internal output 051, causing switch 051 in a by-pass circuit to close and hold internal output 051 energized independently of the splice switch, and operating output terminal switch 051 to turn on a console indicating light labelled "SPLICE"; and closes switch 056 in the next lower logic circuit, thereby energizing internal output 044 (switch 063 shown normally open is closed when the AC power to the machine is on as here, see Emergency Stop Signal at bottom of FIG. 9), causing switch 044 in a by-pass circuit to close and hold internal output 044 energized, and operating output terminal switch 044 to energize solenoid 044, which actuates pneumatic cylinders 92, 70 to raise anvil bar 88 and splice roll 60, and solenoid 044A, which causes air to commence blowing from holes 96.

When internal output 044 is energized the controller functions as if it opens normally-closed switch 044 in the lowermost logic circuit, thereby de-energizing internal output 066 (which was previously held energized by switch 066 after the reset button was pushed and internal output 057 was momentarily energized) which switches chain drive 55 from its tension-regulated variable-speed mode to its speed-match mode.

When anvil limit switch 95 is contacted by stop finger 93 on the extending anvil arm 56 (web 6 is by then severed and adhered to new core 12'), input terminal 62 is energized and functions as if it:

closes switch 062 in the logic circuit immediately to its right, thereby energizing internal output 045 (switch 063 being closed), causing switch 045 in a bypass circuit to close and hold internal output 045 energized, and operating output terminal switch 045 to energize solenoid 045; and opens normally-closed switch 062 in the next above logic circuit, thereby de-energizing internal output 044, which opens output terminal switch 044, de-energizing solenoids 044 and 044A, cutting off the blowing air, and, in combination with the previous-mentioned energizing of solenoid 045, retracting the piston rods of anvil and splice roll cylinders 92, 70, respectively.

With internal output 045 energized, the controller functions as if it:

closes switch 045 in the next lower logic circuit, energizing internal output 040, which operates output terminal switch 040 to energize solenoid 040, thereby actuating pneumatic cylinders 38 to raise roll release pins 30; and closes switch 045 in the next lower logic circuit, energizing time-delayed internal output 072, indicated by a "T" superscript, which after a preset time period operates all switches 072, one of switches 072 in a by-pass circuit thereby closing and holding internal output 072 energized.

After the pre-set time period, when switches 072 are operated by internal output 072, the controller further functions as if it:

opens normally-closed switch 072 in the second above logic circuit, thereby de-energizing internal output 045 (which action has no effect on the already-retracted pneumatic cylinders 92, 70);

closes switch 072 in the lowermost logic circuit, thereby energizing internal output 066 and causing switch 066 in the upper leg of the logic circuit to close and hold internal output 066 energized (switch 044 in the same leg is closed because internal output 044 is de-energized), thereby returning chain drive 55 to its tension-regulated variable-speed mode;

closes switch 072 in the uppermost logic circuit, thereby energizing internal output 041, and operating output terminal switch 041 to energize solenoid 041, which actuates pneumatic cylinders 38 to restore roll release pins 30 to their normal down position;

opens normally-closed switch 072 in the next to uppermost logic circuit, thereby de-energizing internal output 047, which had been held energized by switch 047 after the "LOAD CORE" pushbutton was momentarily pushed at an earlier stage in loading the machine; and closes switch 072 in the logic circuit to the right of the "RELEASE CORE" pushbutton thereby energizing internal output 046, causing switch 046 to close and hold internal output 046 energized (switch 063 is closed when AC power is on as here; switch 047 is closed now that internal output 047 is de-energized, and switch 054 is closed because the load core pushbutton is not depressed), and operating output terminal switch 046 to energize solenoid 046, which actuates cylinders 104 to raise knife bar 102 and rods 106.

When internal output 46 is energized, the controller further acts as if it:

opens normally-closed switch 046 in the next to lowermost logic circuit, thereby de-energizing internal output 072, which restores all 072 switches to their normal position, which action has no immediate external effect except to deenergize internal output 041 and thereby solenoid 041 (The roll release pin is not moved, however, as previous energization of solenoid 041 left release pins 30 down, and solenoid 040 (bottom of FIG. 9) must be energized to raise the pins.); and closes switch 046 in the logic circuit to the left of solenoid 052 (middle of FIG. 9), thereby energizing internal output 052 (switch 042 being closed because internal output 042 was previously held energized by yet to be described core loading operations) and operating output terminal switch 052 to energize solenoid 052, which actuates pneumatic cylinders 34 to raise latch pins 32.

When shoes 130 have pushed new mandrel 14' into the rewinding station, past raised latch pins 32 (shoes 130 began to move as soon as solenoid 046 caused knife cylinder rods 106 to retract, because solenoid 042 was energized by earlier but yet to be described core loading operations), shoe forward limit switch 182 is closed to energize input terminal 060 which functions as if it:

closes switch 060 in the logic circuit immediately to its right, thereby energizing internal output 043 and operating output terminal switch 043, which energizes solenoid 043; and opens normally-closed switch 060 in the second above logic circuit, thereby de-energizing internal output 042 and thus solenoid 042, which was energized when cores were initially loaded into the machine, and which, combined with energization of solenoid 043, causes the piston rods of cylinders 156 to extend, retracting shoes 130.

Limit switch 182 is only momentarily closed, opening when shoes 130 retract, and thus internal output 043, output terminal 043, and solenoid 043 are similarly only momentarily energized. This is sufficient however to move the valve controlling shoe cylinders 156 into a detented extend position.

De-energizing internal output 042 causes the controller to function as if it opens switch 042 in the third below logic circuit, thereby de-energizing internal output 052 and opening output terminal switch 052, which de-energizes solenoid 052 and restores latch pins 32 to their normal down position, holding the winding mandrel and roll in place.

When shoes 130 reach their fully retracted position, shoe retract limit switch 184 is closed, energizing input terminal 061, which functions as if it:

closes switch 061 in the logic circuit at its immediate right, thereby energizing internal output 047 (internal outputs 055 and 072 are de-energized, leaving switches 055 and 072 closed; AC power is on, closing switch 063), causing switch 047 in a by-pass circuit to close and hold internal output 047 energized, and operating output terminal switch 047 to energize solenoid 047 (the on/off switch between AC power line 404 and output terminals 047, 044, and 045 is an interlock switch on the controller access door designed to prevent either the knife, anvil, or splice roll from operating when the door is open), which actuates pneumatic cylinders 104 to lower knife bar 102 and rods 106 (energizing internal output 047 and closing switch 061 have de-energized solenoid 046);

closes switch 061 in another leg of the same logic circuit (the switch stays closed until shoes 130 move forward off limit switch 184); and closes switch 061 in the next lower logic circuit, thereby energizing internal output 050 (switch 047 being closed by energization of internal output 047), causing switch 050 in a by-pass circuit to close and hold internal output 050 closed, and operating output terminal switch 050 to energize solenoid 050, which actuates core load cylinder 141, releasing a new mandrel 14' which rolls down guideway 135 into channels 24 at channel entrances 124.

Energizing internal output 050 causes the controller to act as if it closes switch 050 connected to time-delayed internal output 071, thereby energizing internal output 071, which after a pre-set time period operates all switches 071.

After expiration of the pre-set time period, the controller functions as if it:

opens switch 071 in the next above logic circuit, thereby de-energizing internal output 050 and solenoid 050 to deactivate the core load cylinder, which causes mandrels in the loader to advance, readying the loader for the next load operation;

closes switch 071 in the next lower logic circuit, thereby energizing internal output 042 and solenoid 042 to move shoes 130 forward toward newly-loaded mandrel 14' (switch 042 in a by-pass circuit closes to hold internal output 042 and solenoid 042 energized); and opens switch 071 in the splice button logic circuit to turn off the splice light. This ends the splice operation.

To start up an empty machine, the "RESET" button is depressed, energizing input terminal 057 and causing the controller to act as if it:

closes switch 057 in the lowermost logic circuit to switch chain drive 55 into its tension regulated variable speed mode; and closes switch 057 in the uppermost logic circuit to energize solenoid 041 and lower roll release pins 30.

Next, the "LOAD CORE" pushbutton is depressed, energizing input terminal 054 and causing the controller to function in the same sequence as described earlier when shoe retract limit switch 184 was closed and input terminal 061 energized (the machine is started with shoes 130 fully retracted). After this sequence is completed, the newly loaded core is transferred to the rewind station by depressing the "RELEASE CORE" pushbutton, causing the controller to function in the same sequence as described earlier when time-delayed internal output 072 closed switch 072 in the parallel circuit below switch 055.

Figure 10:
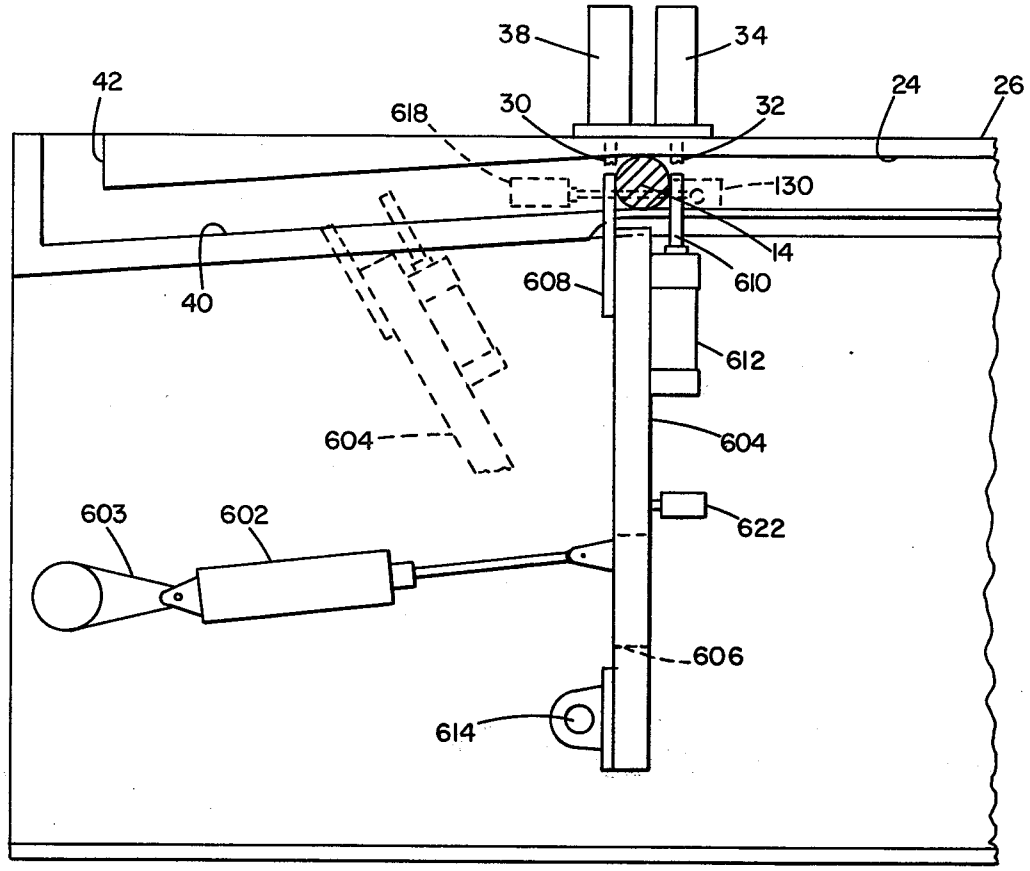
FIG. 10 is a view similar to FIG. 1 but taken along a section inside one frame wall and with the right-hand portion of the apparatus broken away; an ejection mechanism for fully wound rolls is shown added to the apparatus.

To assure that fully wound rolls 11 leave winding station 10 and roll down sloping portions 40 of channels 24 without jamming or skewing, it is preferred that an ejection mechanism, as shown in FIGS. 10 and 11 be incorporated into the winder apparatus. Two arms 604 joined by crossmember 606 have fastened at their upper ends fixed bars 608 and cylinders 612 which actuate ejection pins 610. Bars 608 and pins 610 capture mandrel 14 on each side of the wound roll, bearing against mandrel surfaces 19 (the surfaces that engage belts 72 at the splicing station, see FIG. 4) which are well inboard of roll release pins 30 and latch pins 32 (which are shown broken away in FIG. 10). Ejection cylinder 602 fastened between frame-mounted bracket 603 and crossmember 606 rotates arms 604 on frame-mounted shaft 614.

During web winding arms 604 are upright and ejection pins 610 are up. When the control circuitry retracts release pins 30 (after the web is severed) pressurized air supplied to cylinder 38 actuates suitable control circuitry (e.g., including a pilot-operated pneumatic valve, not shown to cause the piston rod of cylinder 602 to retract, rotating arms 604 and moving mandrel 14 down regions 40 of channels 24. When arms 604 reach the position shown in dashed line in FIG. 10, mandrel 14 and fully wound roll 11 roll free of bars 608 toward roll exit 42, and the arms reach a mechanical stop (not shown), bringing them to rest.

When new mandrel 14 reaches winding station 10, one shoe 130 activates mechanically-actuated pneumatic valve 618, connecting pressurized supply air to additional suitable control circuity (e.g., including another pilot-operated valve, not shown), to cause ejection pins 610 to retract and arms 604 to return to their upright positions. Upon reaching the upright position, cylinder 602 reaches its maximum stroke (stopping arm rotation) and mechanically-actuated pneumatic valve 622 is activated, valve 622 in turn acting through the above mentioned control circuitry to extend ejection pins 610 to capture new mandrel 14.

Valves 618 and 622 are spring loaded to return when actuated to a normal position wherein the output side is vented to the atmosphere at an exhaust port (not shown).

I claim:

1. Apparatus for replacing a rotating mandrel on which a web is wound in a roll, comprising means for supporting a first said mandrel at a main rotation station with said web wound on said mandrel and extending therefrom, means for supporting a second said mandrel at a splicing station spaced from said rotation station, center drive means extending along a rectilinear path between said stations, for rotating said mandrels, splicing means for severing said web and splicing it to said second mandrel, and transfer means for translating said second mandrel along said path after said splicing and while in driving engagement with said drive means.

2. The apparatus of claim 1 wherein said main rotation station is a winding station at which said web is wound into a roll on said first mandrel, and said drive means is adapted to wind said web onto said mandrels.

3. The apparatus of claim 1 wherein bearing surfaces are provided extending along said path and each said mandrel has rollers for engaging said surfaces during said translation.

4. The apparatus of claim 3 wherein said transfer means comprises a shoe for pushing said mandrel from said splicing station to said rotation station.

5. The apparatus of claim 1 further comprising retractable stop pins for retaining said mandrels at said splicing and rotation stations.

6. The apparatus of claim 1 wherein said drive means includes a linearly driven element moving along said path, the linear speed of said element exceeding the speed of translation of said second mandrel to produce rotation thereof during said translation.

7. The apparatus of claim 6 wherein said linearly driven element is a chain and said mandrels have sprocket wheels for engaging said chain.

8. The apparatus of claim 1 comprising opposing guide members having inwardly facing channels extending along said path, and with said mandrels having end portions adapted to be received in said channels.

9. The apparatus of claim 8 wherein said end portions comprise rollers.

10. The apparatus of claim 9 wherein said transfer means comprises pusher shoes movable along said channels to act against said rollers to push said mandrels between stations.

11. As a component of apparatus constructed according to claim 1, a mandrel comprising a main body for supporting said web wound in a roll, first portions adapted for rolling on bearing surfaces that are provided along said path, and a second portion adapted for engaging said drive means over an extended region between said rotation and splicing stations.

12. The mandrel of claim 11 wherein said first portions comprise rollers supported on end portions of said mandrel.

13. The mandrel of claim 11 wherein said second portion comprises a sprocket wheel for engaging a chain of said drive means.

14. Apparatus for replacing a rotating mandrel on which a web is wound in a roll, comprising means for supporting a first said mandrel at a main rotation station with said web wound on said mandrel and extending therefrom, a drive for rotating said first mandrel at said rotation station, means for supporting a second said mandrel at a splicing station spaced from said rotation station, splicing means for severing said web and splicing it to said second mandrel, said splicing means comprising a cutting edge on one side of said web and downstream of said second mandrel at said splicing station, an anvil on the opposite side of said web having a deflecting surface downstream of said cutting edge, means for moving said anvil toward said web to deflect the moving web toward said cutting edge, a splice roll on said opposite side of the web, said splice roll including a freely rotatable peripheral portion for supporting the moving web, and means to move said splice roll toward said web to nip said web against said second mandrel as said anvil deflects said web into contact with said cutting edge.

15. The apparatus of claim 14 wherein said main rotation station is a winding station at which said web is wound into a roll on said first mandrel, and said drive for rotating said first mandrel is adapted to wind said web onto said mandrel.

16. The apparatus of claim 14 wherein said splice roll is rotatably supported about an eccentric axis spaced from its center, whereby rotation of said splice roll about said eccentric axis nips said web against said second mandrel.

17. The apparatus of claim 16 wherein said means to move said splice roll comprises an arm extending from one end of said roll and a fluid-actuated cylinder and piston connected to said arm, whereby extension of said cylinder and piston rotate said roll about said eccentric axis to nip said web against said second mandrel.

18. The apparatus of claim 16 wherein said means for moving said anvil comprises an arm extending from one end of said anvil, said arm being rotatably supported about an anvil axis, and a fluid-actuated cylinder and piston connected to said arm, whereby extension of said cylinder and piston rotates said arm about said anvil axis to move said anvil toward said web.

19. The apparatus of claim 18 further comprising a surface drive for accelerating said second mandrel until its peripheral speed matches the surface speed of said web, said surface drive comprising a pair of belts supported on a pair of pulleys, said pulleys being rotatably supported about a pulley axis, and wherein said mandrels comprise portions for frictionally engaging said belts outboard of said rolls.

20. The apparatus of claim 19 wherein said eccentric axis, anvil axis, and pulley axis are colinear and said splice roll, anvil arm, and pulleys are mounted on idler bearings on a common shaft at said colinear axes.

21. The apparatus of claim 20 wherein said drive for rotating said first core is a center drive which extends along a linear path between said rotation and splicing stations, said center drive comprising a chain extending along said path, sprocket wheels at said winding and splicing stations, for driving said chain, said sprocket wheels at said splicing station being fixed to said common shaft, and a motor for driving said common shaft; and wherein said mandrels further comprise sprocket wheels outboard of said portions for engaging said surface drive, for engaging said chain.

22. The apparatus of claim 14 wherein said splicing means further includes a blade extending from said anvil to contact the web upstream of said cutting edge and downstream of said splice roll, said deflecting surface and said blade thereby forming a well across which the web is tightly stretched and into which said cutting edge extends upon movement of said anvil.

23. The apparatus of claim 14 wherein said splicing means further includes means for blowing air directed toward said second mandrel from the vicinity of said anvil, for blowing said severed end against said second mandrel.

24. The apparatus of claim 14 wherein said splicing means further includes adhesive means applied to said second mandrel, for adhering the severed end of the web to said mandrel.

25. The apparatus of claim 14 wherein said freely rotatable peripheral portion of said splice roll is continually in supporting contact with the moving web.

26. Apparatus for replacing a rotating mandrel on which a web is wound in a roll, comprising means for supporting a first mandrel at a main rotation station, a drive for rotating said first mandrel at said rotation station, means for supporting a second mandrel at an initial station spaced from said rotation station, said mandrels having end portions adapted for rolling, splicing means for severing said web and splicing it to said second mandrel, and transfer means for translating said second mandrel along a path between said stations, said transfer means comprising bearing surfaces for supporting said end portions of said mandrels, pusher shoes adapted to push against said end portions, means to move said pusher shoes, opposing guide members having inwardly-facing channels for receiving said end portions of said mandrels and guiding said pusher shoes, a common shaft rotatably connected to said pusher shoes, rack gears fixed to said guide members and uniformly spaced from said channels along the length of said channels, and pinion gears fixed to said common shaft and engaged with said racks, for rotating along said racks as said shoes move, to thereby maintain alignment between said shoes.

27. The apparatus of claim 26 wherein said means to move said pusher shoes comprises a fluid-actuated cylinder and piston rotatably connected to said common shaft.

28. The apparatus of claim 26 wherein said transfer means further comprises guide blocks rotatably attached to said common shaft and second channels in said guide members spaced from and parallel with said first-mentioned channels, said guide blocks having upper surfaces slideably engaged with upper surfaces of said second channels, thereby preventing said shoes from moving upward in said first-mentioned channels.

29. Apparatus for replacing a rotating mandrel on which a web is wound, wherein said mandrels have first portions adapted for rolling and second portions adapted for engaging a drive, said apparatus comprising track means adapted to support said first portions of said mandrels and defining a substantially rectilinear transfer path for said mandrels, transfer means for causing transfer of said mandrels along said path by rolling of said first portions thereof on said track means; and drive means for rotating said mandrels, said drive means being adapted to have operative engagement with said second portions of said mandrels while said mandrels are rolling in said track means along said path.

30. The apparatus of claim 29 wherein said first portions comprise rollers supported on the ends of said mandrels, for engaging inwardly-facing channels in said track means.

31. The apparatus of claim 29 wherein said drive means comprises chains for engaging sprocket wheels on said mandrels over an extended region along said track means.

32. The apparatus of claim 31 wherein said drive means is a center drive for said mandrels, which also includes a surface drive means for said mandrels, and wherein said mandrels include means permitting simultaneous engagement of said mandrels with said center and surface drives, thereby allowing said surface drive to turn said mandrel at a higher angular speed than said center drive.

33. The apparatus of claim 32 wherein said means permitting simultaneous engagement is an overrunning clutch mounted between said sprocket wheels and the main body of the mandrels.

34. The apparatus of claim 29 which further comprises means for loading said mandrels into operative engagement with said drive means comprising guide means for supporting said mandrels, said guide means including bearing surfaces sloping upward from adjacent said track means, for supporting said second portions of said mandrels, first retention means along said guide means, for retaining a first one of said mandrels, and retraction means to retract said first retention means to allow said first mandrel to roll down said sloping bearing surfaces into said track means.

35. The apparatus of claim 34 which includes additional retention means along said guide means upstream of said first retention means for retaining additional mandrels, and means for manipulating said additional retention means to cause said additional mandrels to roll along said guide means and successively replace said first one of said mandrels.

36. The apparatus of claim 35 wherein said first and additional retention means comprise pins extending above said bearing surfaces and engaging the downstream side of end portions of said mandrels.

37. Apparatus for replacing a rotating mandrel on which a web is wound in a roll, comprising means for supporting a first said mandrel at a main rotation station with said web wound on said mandrel and extending therefrom, a center drive for rotating said first mandrel at said rotation station, means for supporting a second said mandrel at a position spaced from said rotation station, a surface drive for accelerating said second mandrel until its peripheral speed matches the surface speed of said web extending from said first mandrel, and splicing means for severing said web and splicing it to said accelerated second mandrel, and wherein said splicing means comprises a cutting edge on one side of said web and downstream of said second mandrel at said splicing station, an anvil on the opposite side of said web having a deflecting surface downstream of said cutting edge, means for moving said anvil toward said web to deflect the moving web toward said cutting edge, a splice roll on said opposite side of the web, said splice roll including a freely rotatable peripheral portion for supporting the moving web, and means to move said splice roll toward said web to nip said web against said second mandrel as said anvil deflects said web into contact with said cutting edge.

38. The apparatus of claim 37 wherein said splice roll is rotatably supported about an eccentric axis spaced from its center, whereby rotation of said splice roll about said eccentric axis nips said web against said second mandrel.

39. The apparatus of claim 27 wherein said splicing means further includes a blade extending from said anvil to contact the web upstream of said cutting edge and downstream of said splice roll, said deflecting surface and said blade thereby forming a well across which the web is tightly stretched and into which said cutting edge extends upon movement of said anvil.

40. The apparatus of claim 37 wherein said splicing means further includes means for blowing air directed toward said second mandrel from the vicinity of said anvil, for blowing said severed end against said second mandrel.

41. The apparatus of claim 40 wherein said splicing means further includes adhesive means applied to said second mandrel, for adhering the severed end of the web to said mandrel.

* * * * *

UNITED STATES PATENT AND TRADEMARK OFFICE

CERTIFICATE OF CORRECTION

PATENT NO. : 4,204,650

DATED : May 27, 1980

INVENTOR(S) : William R. Mengel

It is certified that error appears in the above-identified patent and that said Letters Patent are hereby corrected as shown below:

Col. 5, line 45, change "138" to --139--;

line 60, change "in" second occurrence --is--;

Col. 12, line 48, change "Figs. 10 and 11" to --Fig. 10--;

line 66, change "not shown" to --, not shown)--;

Col. 13, line 1, change "dashed line" to --dashed lines--;

line 18, change "actuated" to --unactuated--;

Col. 18, line 14, change "27" to --37--.

Signed and Sealed this

*Twenty-third* Day of *September 1980*

[SEAL]

*Attest:*

SIDNEY A. DIAMOND

*Attesting Officer*

*Commissioner of Patents and Trademarks*